United States Patent [19]

Dasa

[11] Patent Number: 5,007,875

[45] Date of Patent: Apr. 16, 1991

[54] MULTIPLE CONFIGURATION MODEL AIRCRAFT

[76] Inventor: Madhava Dasa, P.O. Box 461, Kula, Hi. 96790-0461

[21] Appl. No.: 103,954

[22] Filed: Oct. 2, 1987

[51] Int. Cl.[5] ..... A63H 27/18

[52] U.S. Cl. ..... 446/66; 446/68

[58] Field of Search ..... 446/61, 62, 63, 64, 446/65, 66, 67, 68, 94

[56] References Cited

U.S. PATENT DOCUMENTS

| | | | |
|---|---|---|---|
| 2,739,414 | 3/1956 | Cleveland | 446/66 |
| 4,203,250 | 5/1980 | Garofalo | 446/61 |
| 4,698,041 | 10/1987 | Dasa | 446/61 |

FOREIGN PATENT DOCUMENTS

| | | | |
|---|---|---|---|
| 416085 | 11/1946 | Italy | 446/64 |
| 1051368 | 12/1966 | United Kingdom | 446/61 |
| 1492758 | 1/1978 | United Kingdom | 446/63 |

*Primary Examiner*—Mickey Yu

[57] ABSTRACT

A multiple configuration model aircraft kit which enables the purchaser to assemble a plurality of model aircraft configurations, uses a relatively small number of components. The components of the model aircraft kid comprise at least one wing or primary lifting surface, one stabilizer and one fuselage or two secondary plane surfaces, and connector means. One of the secondary plane surfaces may alternately function as a fuselage or as a flight surface. Releasable connecting means are used to join the components thereby providing a plurality of configurations. Twin secondary plane surfaces may be provided which may be used alternately as wing tip flight surface extensions, dual fuselages, or as other flight surfaces.

4 Claims, 3 Drawing Sheets

FIG. 1
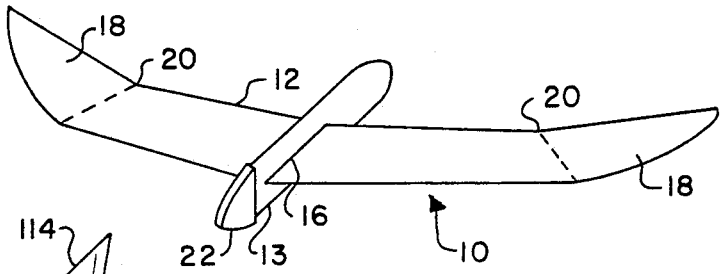
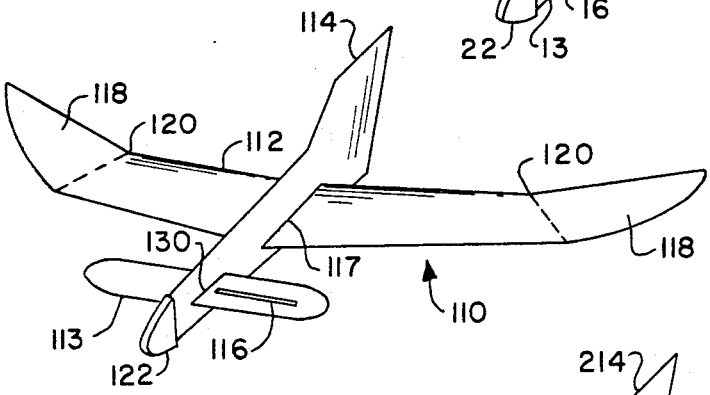
FIG. 2
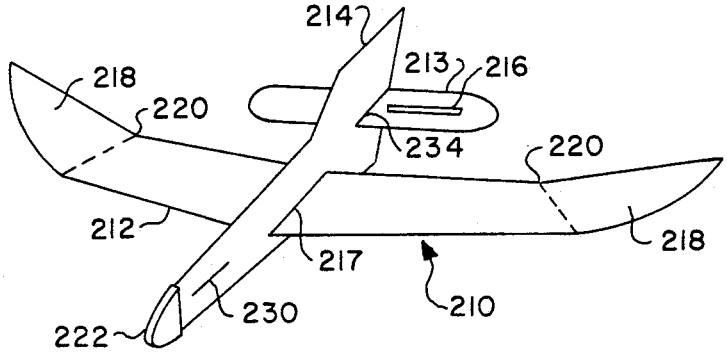
FIG. 3
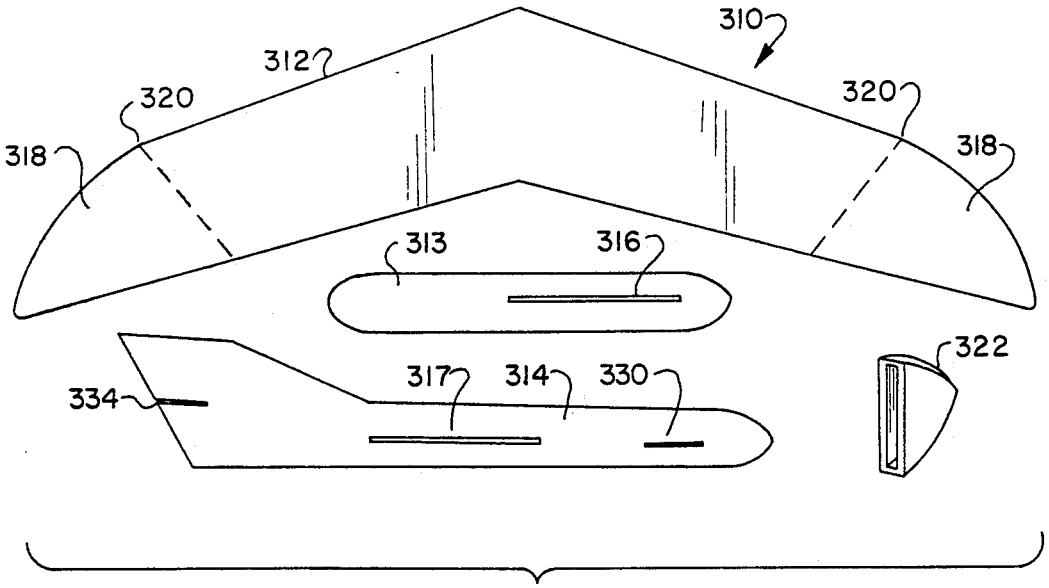
FIG. 4

MULTIPLE CONFIGURATION MODEL AIRCRAFT

BACKGROUND OF THE INVENTION

1. Field of the Invention

The present invention relates generally to model aircraft; and, more particularly, to toy gliders which have action imparted to them by a user's hand or by a launching device such as a catapult or by any other device capable of imparting action. The present invention also relates generally to mechanically or electromechanically remote controlled model aircraft.

2. Description of the Prior Art

Prior art multiple configuration model aircraft kits achieved a variety of configurations and planforms by adaptably using a relatively small number of parts. The present invention, however, will further reduce the number of parts in a multiple configuration model aircraft kit and will generally improve the overall desirability of the product.

The prior art embodied in U.S. Pat. No. 4,698,041 shows a multiple configuration model aircraft having a plane surfaces which may support other plane surfaces via suitable connectors. It also shows fuselage pieces always being utilized as fuselage pieces and plane surfaces always being utilized as plane surfaces. The prior art multiple configuration model aircraft additionally allows at least one configuration wherein all of the parts in the kit are not used, leaving disconnected parts to be misplaced or lost.

SUMMARY OF THE INVENTION

An object of the present invention is to provide simplified and alternative structure for a multiple configuration model aircraft. In simple form the model aircraft kit of the present invention has component parts comprising a fuselage and a nose weight, a main wing, and a horizonal stabilizer which may alternatively be used as an additional fuselage. By incorporating releasable connector means, the component parts of the kit may be assembled such that the model aircraft obtains standard, canard, and flying wing configurations as desired.

Another object of the present invention is to provide a multiple configuration model aircraft kit wherein all component parts of the kit are fully utilized in all configurations, leaving no extra parts to be misplaced.

These and other objects of the present invention will become more apparent in the following description of the prefered embodiments.

BRIEF DESCRIPTION OF THE DRAWINGS

FIGS. 1, 2 and 3 are perspective views illlustrating the configurations of a first embodiment.

FIG. 4 is a separated view of the component parts of the embodiment illustrated in FIGS. 1 through 3.

DETAILED DESCRIPTION OF THE PREFERRED EMBODIMENTS

A First Embodiment

Figure 5:
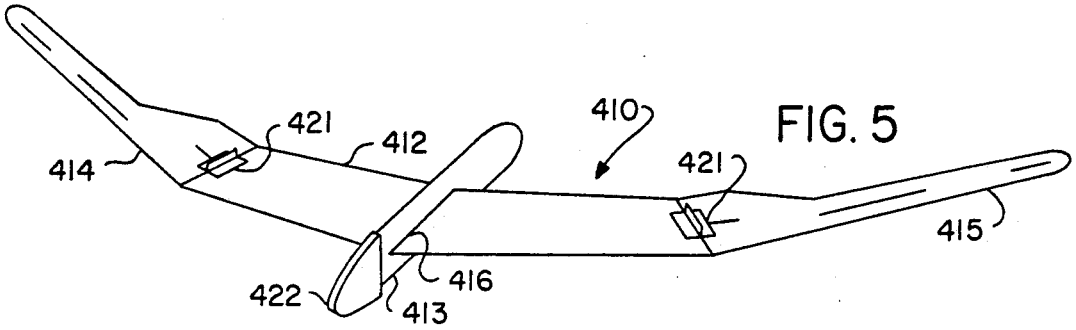
FIGS. 5, 6, 7 and 8 are perspective views illustrating many of the possible configurations of a second embodiment.

A model aircraft may be hand launched, launched from an appropriate catapult or other suitable device, and may be mechanically or electromechanically remote controlled. The launching means is not shown in the drawings.

Referring to FIGS. 1 through 3, a first embodiment of the aircraft kit is shown. This kit may be used to form a flying wing 10, as shown in FIG. 1, or two different aircraft configurations 110 and 210, as shown in FIGS. 2 and 3. The model aircraft 10 has a primary lifting surface comprising a wing panel 12 attached to the fuselage 13 by means of a slot 16. The fuselage 13 is a planar member of elongate configuration with the slot 16 extending in the direction of elongation. Wing panel 12 has a longitudinal centerline and left and right wing portions symmetrical about the centerline and is preferably made of scorable and foldable material such as foam polystyrene sheet. The end sections 18 of the wing panel 12 are scored and turn upward along rearwardly converging fold lines 20. The fuselage 13 has an attached weight 22 which facilitates proper aerodynamic balance during flight and cushions against shock from a frontal impact.

A model aircraft 110 which is similar to the configuration of the model aircraft 10 depicted in FIG. 1 except that the configuration in FIG. 2 employs a different fuselage 114 with a horizontal stabilizer 113 at the front of the fuselage. This fuselage 114 is a second planar member wiht an elongate body portion having a front end portion and an enlarged rear end portion and provided, in the body portion, with two slots extending in the direction of elongation, and in the rear end portion, with a third slot also extending in the direction of elongation. The horizontal stabilizer 113 of this configuration is the planar member 13 which forms the fuselage in the FIG. 1 configuration. Wing panel 112 is attached to the fuselage 114 by means of a slot 117. The fuselage has a transverse slot 130 extending through the body of the fuselage near the front end of the fuselage. The end sections 118 of the wing panel 112 are turned upward along foldlines 120 similar to the corresponding parts of FIG. 1, or they may be extended straight out. The fuselage 114 has an attached weight 122 which has its companion part in FIG. 1.

FIG. 3 depicts a model aircraft 210, which is similar to the configuration depicted in FIG. 2 except that a fuselage 214 has a rear slot 234 that receives a rear horizontal stabilizer 213. Wing panel 212, slot 216, end section 218, foldline 220, weight 222 and forward transverse slot 230 are similar in function and composition to their companion parts depicted in FIG. 2. The fuselage 214 can be used as the fuselage depicted in FIG. 2, since it accommodates two slots 234 and 230.

Referring to FIGS. 1 through 4 and more specially to FIG. 4, component parts 310 are assembled providing various configurations of the model aircraft 10, 110 and 210. These component parts 310 are a fuselage 314, a wing panel 312, wing tips 318, foldlines 320, a horizontal stabilizer or fuselage 313 and a weight 322. The fuselage 314 has preferrably a forward transverse slot 330, a central slot 317 and a rear slot 334. The horizontal stabilizer or fuselage 313 has a slot 316.

It is understood and is readily apparent from viewing FIGS. 1 through 4 that the component parts 310 are considered in combination as model aircraft kit capable of producing at least the various configured model aircraft 10, 110 and 210 when the component parts 310 are particularly assembled. It is equally apparent that the part 313 may be alternately used as a horizontal stabilizer or a fuselage.

A Second Preferred Embodiment

Figure 6:
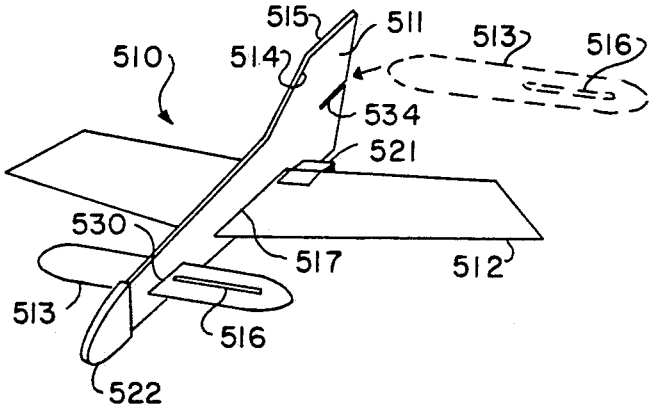
Figure 7:
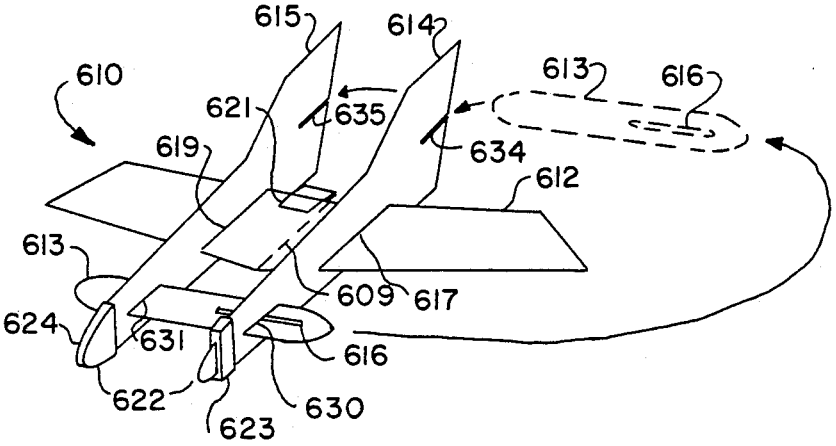
Figure 8:
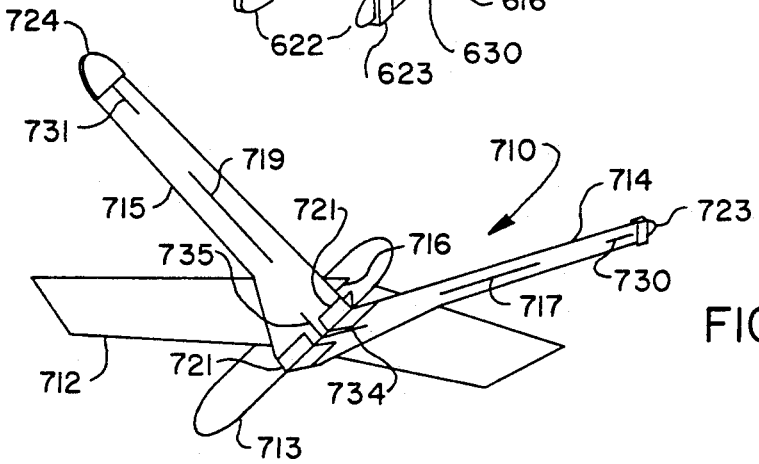

Referring to FIGS. 5 through 8, a second embodiment of the aircraft kit is illustrated. The kit of this embodiment may be used to form a flying wing 410, as shown in FIG. 5, or a number of different aircraft configurations 510, 610, 710, as shown in FIGS. 6, 7 and 8. The model aircraft 410 has a primary lifting surface comprising a wing panel 412 attached to a fuselage 413 by means of a slot 416. Wing appendages 414 and 415 are connected to the tips of wing panel 412 by a pair of releasable wing appendage connectors 421. The fuselage 413 has an attached weight 422. Each wing appendage connector 421 is preferably made of plastic and has a slot which receives a wing appendage 414 or 415. The wing appendage connectors 421 also have another slot into which wing panel 412 is inserted at a suitable angle.

Referring to FIG. 6, a model aircraft 510 is similar to the configuration of the model aircraft 410 depicted in FIG. 5 except that the configuration of FIG. 6 employs a different fuselage 511 consisting of subparts 514 and 515 with a horizontal stabilizer 513 at the front of the fuselage. Horizontal stabilizer 513 corresponds to the fuselage 413 of FIG. 5 and has a slot 516. Horizontal stabilizer 513 is also shown in a moved position near the rear of fuselage 511.

Fuselage subpart 515 is a duplicate of fuselage subpart 514. Only fuselage part 514 will be described. Fuselage part 514 has a transverse slot 517 approximately in the center of the fuselage 514 which receives wing panel 512. The fuselage part 514 further includes a transverse slot 530 located near the front of the fuselage 514 and a transverse slot 534 located at the rear of the fuselage part 514. Horizontal stabilizer 513 is inserted through slot 530 and the corresponding slot of fuselage subpart 515. Weight 522, corresponding to weight 422 of FIG. 5 joins fuselage subparts 514 and 515 together. Wing appendage connectors 521 (only one visible) are positioned on the trailing edge of wing panel 512.

FIG. 7 depicts another configuration of a model aircraft 610 which is similar to the configuration depicted in FIG. 6 except that the fuselage subparts 614 and 615 are split outboard of the wing centerline 609 and except that nose weight 622 consists of two parts 623 and 624 attached to the front of fuselage parts 614 and 615 respectively. Wing panel 612, horizontal stabilizer 613, slots 616, 617, 619, 630, 634, and 635, and wing appendage connectors 621 (only one visible) all have similar functions and compositions to their companion parts as shown in FIG. 6.

FIG. 8 depicts yet another configuration of a model aircraft 710 which has a rearward wing 712 and a forward wing consisting of parts 714 and 715. Rearward wing 712 is attached to fuselage 713 by means of a slot 716, forward wing parts 714 and 715 are attached to fuselage 713 by connectors 721. Connectors 721 have three slots which receive wing parts 714 and 715 and fuselage 713. Wing parts 714 and 715 have slots 730 and 731, 717 and 719, and 734 and 735 respectively, and weights 723 and 724 are attached to wing parts 714 and 715 respectively.

Figure 9:
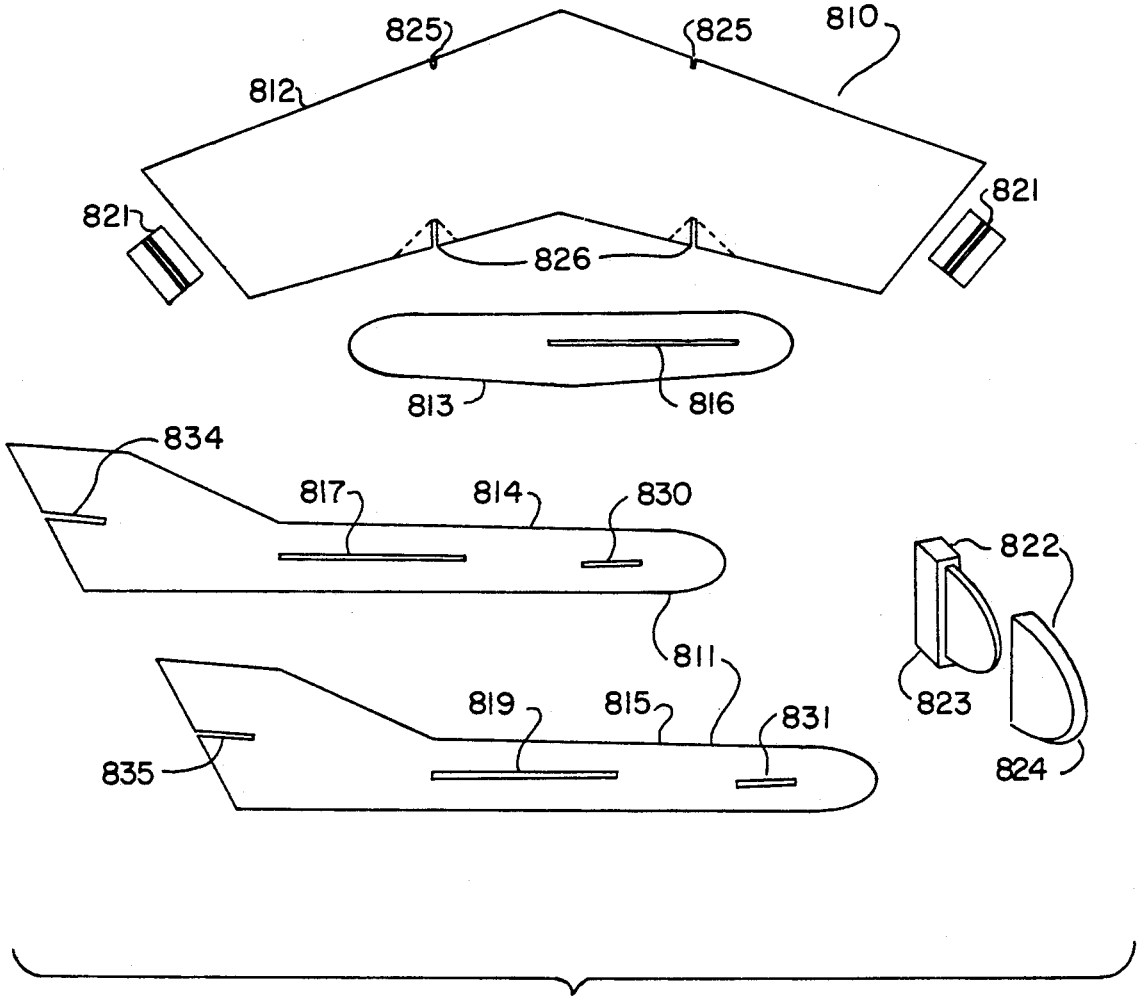
FIG. 9 is a separated view of the component parts of the embodiment illustrated in FIGS. 5 through 8.

Referring to FIGS. 5 through 9 and more specifically to FIG. 9, component parts 810 are assembled providing various configurations of the model aircraft 410, 510, 610 and 710. These component parts 810 are a wing panel 812, a first planar member of elongate configuration having a slot extending in the direction of elongaion and usable either as a horizontal stabilizer of fuselage 813, a composite fuselage 811 consisting of subparts 814 and 815, each of which is a second elongate member having a front end portion and an enlarged rear portion, and provided, in the body portion, with two slots extending in the direction of elongation, and in the rear end portion, with a third slot also extenidng in the direction of elongation, releasable connectors 821 which connect fuselage subparts of plane surfaces 814 and 815 to wing panels 812 or to fuselage or horizontal stabilizer 813, and a weight 822 consisting of subparts 823 and 824. The fuselage subparts 814 and 815 have preferably forward transverse slots 830 and 831, central slots 817 and 819 and rear slots 834 and 835. The horizontal stabilizer or fuselage 813 has a slot 816. Wing panel 812 has a pair of notches 825 and a pair of notched tabs 826 which align fuselage subparts 814 and 815 when fuselage subparts are deployed as shown in FIG. 7.

Figure 10:
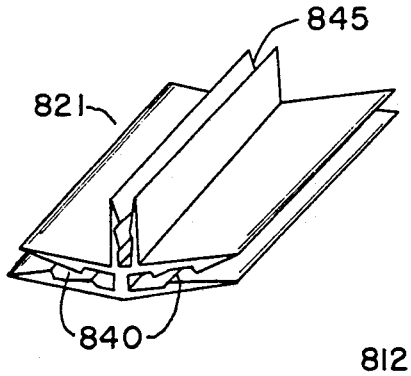
FIG. 10 is a perspective view of one of the pair of releasable connectors depicted in FIGS. 5 through 8.

FIG. 10 illustrates one of the pair of connectors 821 which connect fuselage subparts 814 and 815 to wing part 812 as shown in FIG. 5. Connector 821 may also connect fuselage subparts 814 and 815 to fuselage or horizontal stabilizer 813 as shown in FIG. 8. Connector 821 has a pair of slots 840 for receiving, in the first instance, a wing panel 812 and a fuselage subpart of plane surface 814 or 815 as depicted in FIG. 5, and in the second instance, both plane surfaces of fuselage subparts 814 and 815 as shown in FIG. 8. Slot 845 receives fuselage 813 corresponding to fuselage 713 in FIG. 8. If the configuration of FIG. 8 is not desired, slot 845 of connector 821 may be eliminated (for drag reduction).

Figure 11:
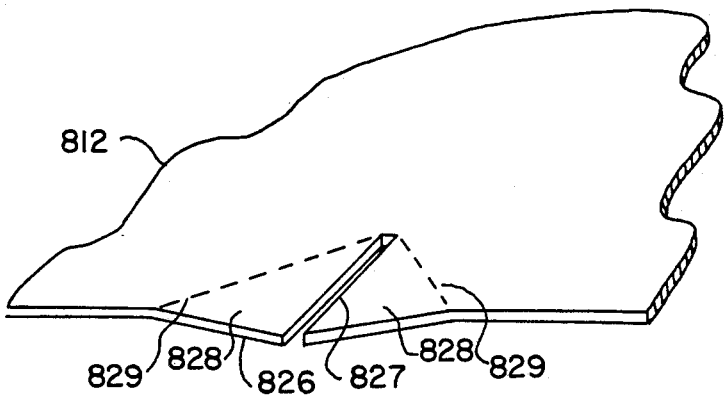
FIG. 11 is a perspective view of one of the pair of fuselage aligners depicted in FIG. 9.

FIG. 11 illustrates one of the pair of fuselage aligners 826. Aligner 826 has slot 827 which allows tabs 828 to be folded along foldlines 829. With fuselage subparts 814 and 815 in place as shown in FIG. 7 and pulled back into forward notches 825, tabs 828 are then displaced away from slots 817 and 819. The forward notches 825, and rearward folded tabs 828 comprising aligners 826 prevent lateral movement of fuselage subparts 814 and 815 along wing panel 812.

The first embodiment as detailed in FIGS. 1 through 4 reveals simplified sructure for a three fold multiple configuration model aircraft. The second preferred embodiment as detailed in FIGS. 5 through 11 reveals a multiple configuration model aricraft in which no fuselage parts or no plane surface parts remain unattached or are left unutilized in any configuration.

It is understood that the described preferred embodiments are illustrative of some of the may specific embodiments which represent applications and principals of the present invention. Clearly, numerous and varied other arrangements may be devised by those skilled in the art without departing from the spirit and scope of the invention.

I claim:

1. A model aircraft kit including constituent parts which are adapted to be assemblied together in connected relation in differing model aircraft configurations providing correspondingly different model aircraft appearances and aerodynamic characteristics, comprising:

a wing panel having a longitudinal center line and and left and right wing portions symmetrical about the centerline;

a first planar member of elongate configuration having a slot therein extending in the direction of elongation, said wing panel being insertable into said slot of said first planar member in the first configuration of the model aircraft; and at least one second planar member having an elongate body portion, a first end portion at one end of said body portion and a second, enlarged end portion at the opposite end of said body portion, said second planar member also having a first slot in said body portion thereof extending in the direction of elongation and of such length in said body portion thereof extending in the direction of elongation and of such length as to receive said wing panel, and a third slot in said second end portion, said wing panel being insertable into said second slot in the second and third configurations of the model aircraft and said first planar member being insertable into said first slot in the second configuration thereof and into said third slot in the third configuration thereof.

2. The model aircraft kit of claim 1 wherein said kit includes two said second planar members of identical configuration, said two second planar members being in abutting side-by-side relation in the second and third configurations of said model aircraft and in equally spaced apart relation on opposite sides of the centerline of said wing panel in fourth and fifth configurations corresponding otherwise to said second and third configurations, respectively.

3. The model aircraft kit of claim 2 wherein said wing panel has, on one edge thereof, tab portions which are foldable relative to the body of said wing panel to secure said two second planar members in each of said fourth and fifth configurations.

4. The model aircraft kit of claim 1 wherein said kit further includes a plurality of releasable connector means for engaging said second end portions of said second planar members and connecting the same to other of the constituent parts of said kit whereby additional configurations of the model aircraft are formed.

* * * * *